US005676086A

United States Patent [19]

Watkins

[11] Patent Number: 5,676,086

[45] Date of Patent: Oct. 14, 1997

[54] REAR STORAGE ASSEMBLY FOR WATERCRAFT

[75] Inventor: Scott Watkins, Huntington Beach, Calif.

[73] Assignee: Yamaha Hatsudoki Kabushiki Kaisha, Iwata, Japan

[21] Appl. No.: 709,623

[22] Filed: Sep. 9, 1996

[51] Int. Cl.[6] ..... B63B 35/73

[52] U.S. Cl. ..... 114/270; 114/343; 114/360

[58] Field of Search ..... 114/343, 360, 114/270

[56] References Cited

U.S. PATENT DOCUMENTS

| | | | |
|---|---|---|---|
| 3,982,497 | 9/1976 | Caron | 114/270 |
| 4,909,176 | 3/1990 | Kobayashi | 114/343 |
| 5,095,843 | 3/1992 | Kobayashi | 114/360 |
| 5,390,621 | 2/1995 | Hattori et al. | 114/270 |

*Primary Examiner*—Jesus D. Sotelo

*Attorney, Agent, or Firm*—Knobbe, Martens, Olson & Bear, LLP

[57] ABSTRACT

A small watercraft having a hull with a bow portion and stern portion. A raised pedestal is provided on the hull and supports an elevated seating assembly that includes a seat for accommodating at least one rider. A buoyant storage assembly extends transversely outward from the raised pedestal and is formed integrally with the hull in the stern portion so as to increase the buoyancy and stability of the watercraft in the stern portion when said storage assembly is at least partially immersed in water.

14 Claims, 6 Drawing Sheets

REAR STORAGE ASSEMBLY FOR WATERCRAFT

BACKGROUND OF THE INVENTION

This invention relates generally to a storage assembly for a personal watercraft and more specifically to a rear storage and buoyancy assembly for a personal watercraft.

Small watercrafts of the "personal" type have a narrow, streamlined hull that makes these watercrafts perfect for performing sporting watercraft maneuvers. Although a narrow, streamlined hull is desirable for the personal watercraft to perform these sporting watercraft maneuvers, the compact nature of the hull prevents much of the hull from being used as an area to store personal items and in certain circumstances it does not produce enough buoyancy and stability in the watercraft.

Buoyant storage assemblies that add storage capacity and buoyancy to the hull of a personal wateraft have been provided in the past. One of these assemblies included removable side containers for the sides of the hull. These containers extended along the sides of the hull the majority of the length of the hull. The containers provided additional storage capacity and buoyancy for the watercraft. One problem with this assembly was that it did not allow for simultaneous additional storage capacity and a sporting hull arrangement because when the side containers were attached to the hull, they decreased the sportiness of the hull, but when they were not attached, additional storage capacity was not provided.

Another storage assembly that was provided in the past included longitudinally-elongated storage areas located within raised gunnels at the sides of the personal watercraft. This storage assembly was designed to hold longitudinally-elongated storage items, such as fishing poles, and provide additional buoyancy and stability in the personal watercraft. One problem with this assembly was that it did not provide much storage capacity for items that did not have a longitudinally-elongated shape.

Another problem with these assemblies was that they did not add enough buoyancy in the stern portion of the watercraft for a difficult boarding situation. During sporting multiple-rider operation of the personal watercraft, it is quite common for riders to fall off of the watercraft. After falling off, the riders are required to board the watercraft from the rear, one rider at a time. Later riders in this multiple boarding process have a more difficult time boarding than earlier riders because the success of their boarding depends on the cooperative balance among the riders. Although the buoyant storage assemblies in the past added buoyancy to the watercraft in general, they did not add enough buoyancy and stability to the stern portion of the watercraft to assist the rider in a difficult boarding situation.

It will be shown by the ensuing description of the present invention how the present invention solves the problems mentioned above.

SUMMARY OF THE INVENTION

A small watercraft having a hull with a bow portion and stern portion. A raised pedestal is provided on the hull and supports an elevated seating assembly that includes a seat for accommodating at least one rider. A buoyant storage assembly extends transversely outward from the raised pedestal and is formed integrally with the hull in the stern portion so as to increase the buoyancy and stability of the watercraft in the stern portion when said storage assembly is at least partially immersed in water.

DETAILED DESCRIPTION OF THE PREFERRED EMBODIMENT

Figure 1:
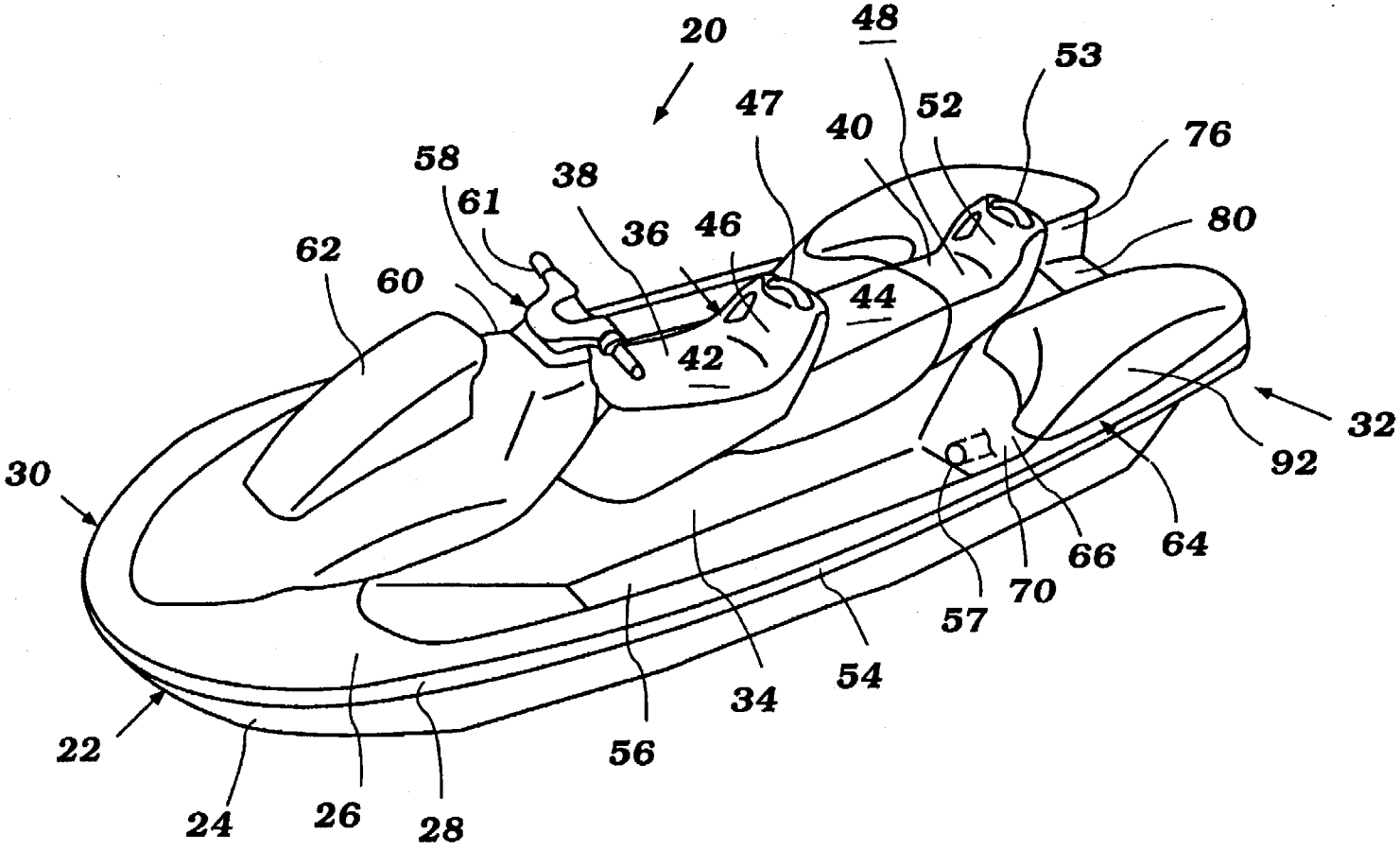
FIG. 1 is a perspective view of a first embodiment of the buoyant storage assembly on a personal watercraft.
Figure 2:
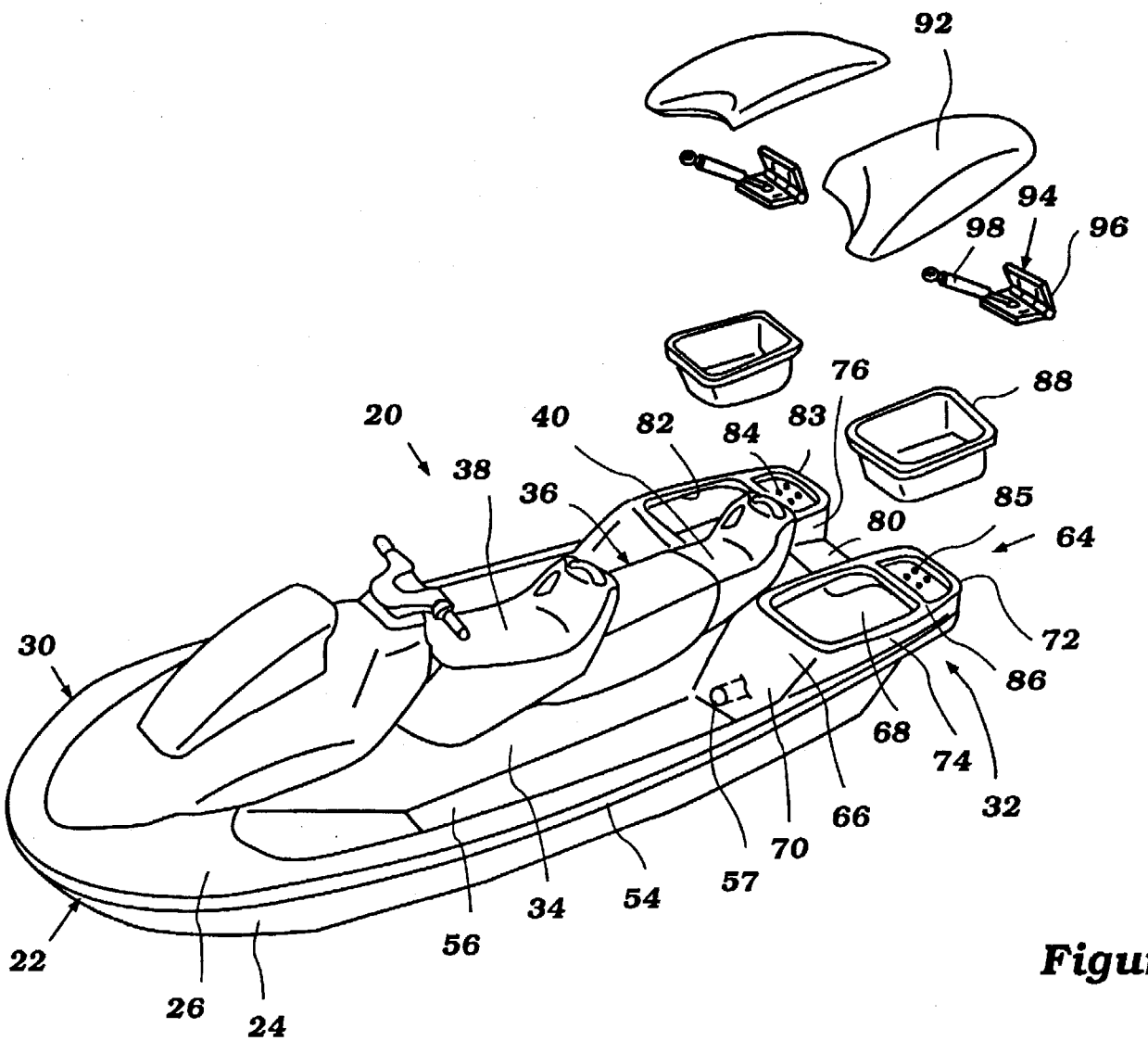
FIG. 2 is a similar view to FIG. 1 and includes a partially exploded view of the buoyant storage assembly.

Referring now in detail to the drawings, and initially to FIGS. 1 and 2, a small watercraft having a buoyant storage assembly constructed in accordance with an embodiment of the invention is identified generally by the reference numeral 20. The small watercraft 20 in the illustrated embodiment is of the personal type and includes a hull 22 having a lower hull portion 24 and an upper deck portion 26 secured together at a gunnel 28 that extends around the outer periphery of the watercraft 20. The hull portions 22 and 24 are formed from a suitable material such as molded fiberglass reinforced resin or the like. The hull 22 also includes a bow portion 30 and a stern portion 32.

The upper deck portion 26 includes a raised pedestal 34 that extends in a generally vertical direction. A portion of the raised pedestal 34 accommodates an elevated seat assembly, indicated generally by the reference numeral 36. Seat assembly 36 is adapted to seat an operator and one or more passengers in a straddle, tandem-type fashion. Together, the seat assembly 36 and raised pedestal 34 form a riders area.

The seat assembly 36 includes a removable front seat 38 and rear seat 40. The removable front seat 38 allows access to an engine compartment, to be described. Front seat 38 includes an operator sealing portion 42 and a first passenger seating portion 44 separated by a seat support 46. The seat support 46 provides lower back and lateral hip support for an operator. A rear side of the seat support 46 may provide back support for an occupant facing in a rearward direction in the first passenger seating portion 44. The seat support 46 includes a handle 47 for providing a passenger with additional support during operation of the watercraft.

The rear seat 40 includes a second passenger seating portion 48. A seat support 52, similar in construction and function to seat support 46, is provided at the rear of the second passenger seating portion 48. Along with the support provided for the rider, this seat support 53 also provides additional support for a person, such as a mechanic, when servicing the engine. Seat support 52 includes a handle 53 that furnishes additional support for a rider facing in a rearward direction on the seat 36 and for a rider when boarding the watercraft.

A pair of raised gunnels 54 are spaced outwardly from the raised pedestal 34. The areas between the raised pedestal 34 and raised gunnels 54 form foot areas 56 on which the operator and passengers may place their feet. The foot areas include drain hoses 57 for draining water from the foot areas 56.

A steering handlebar assembly 58 is provided on a raised bridge 60 in front of the seat assembly 36. The steering assembly 58 includes a pair of handlebars 61 that are coupled to a steering nozzle (not shown), in a well-known manner, so as to permit steering of the watercraft 20.

The bow portion 30 of the upper deck 26 accommodates a removable hatch cover 62. A storage container (not shown) may be provided below the hatch cover 62 for storing personal items. The storage container may include a seal for sealingly engaging the hatch cover 62 with the storage container in order to prevent water from entering the storage container.

An engine compartment is formed within the hull, primarily beneath front seat 38 and raised bridge 60. An engine is received in this area and may be of any known type. The engine drives a jet propulsion unit (not shown), which is positioned beneath the rear seat 40. However, since the jet propulsion unit of the watercraft 20 forms no part of the invention, a further description of it is believed to be unnecessary.

Referring primarily to FIG. 2, a first embodiment of the present invention will now be described. A buoyant storage assembly, indicated generally by the reference numeral 64, is provided in the stern portion 32 of the watercraft 20. The buoyant storage assembly 64 includes a raised storage housing 66 that is formed integrally with the upper deck portion 26. The housing 66 extends transversely from the raised pedestal 34 to the raised gunnels 54. The housing 66 surrounds the jet propulsion unit and forms a pair of rear storage compartments 68. The housing 66 includes an upwardly-angled front face 70, a generally vertical rear face 72, a generally vertical outer side 74 and a generally vertical inner side 76. The aforementioned drain hose 57 extends from the front face 70 to the rear of the watercraft for removing water from the foot areas 56.

A narrow lower platform 80 is provided directly behind the raised pedestal 34 and is designed to assist a rider in boarding the watercraft 20 from the rear. In the past, the lower platform area was wider and communicated with the foot areas 56 along the sides of the raised pedestal 34 for draining the foot areas 56. By providing a narrow lower platform 80 and drain hoses 57 for the foot areas 56, the present invention permits the areas to the sides of the raised pedestal 34 in the stern portion 32 to be used for the buoyant storage assembly 64.

Each storage compartment 68 includes a generally rectangular hole 82. A recessed area 84 is provided adjacent to each hole 82 for a purpose to be described. The recessed area 84 includes a plurality of fastener holes 85. A flat shoulder 86 is formed at the periphery of the generally rectangular hole 82 and recessed area 84. A storage container 88 is disposed within each of the compartments 68 for storing personal items. Each storage container 88 includes an outer flange 90 that rests on the flat shoulder 86 for supporting the container 88. The containers 88 are removable from the storage housing 66 for gaining access to the jet propulsion unit.

A pair of storage covers 92 are pivotally attached to the recessed areas 84 of the storage housing 66 by a pair of hinge an arrangements 94. Each hinge arrangement 94 includes a pair of pivotally connected hinges 96 that are mounted to the recessed area 84 and storage cover 92 by threaded fasteners (not shown). The hinge arrangement 94 includes a retarding means 98, such as a gas cylinder, for assisting in the opening of the storage cover 92. A seal (not shown) may be provided on the housing 66 or containers 88 for sealingly engaging the covers 92 with the housing 66 or containers 88 so that water is prevented from entering the storage assembly 64. Each of the covers 92 of the storage assembly may include a latching means (not shown) for ensuring that the covers 92 stay tightly closed.

The storage covers 92 open and close towards the riders area so that the storage containers 88 are easily accessible to the riders during use of the watercraft. This arrangement facilitates gaining access to personal storage items during use of the watercraft on the water.

Figure 3:
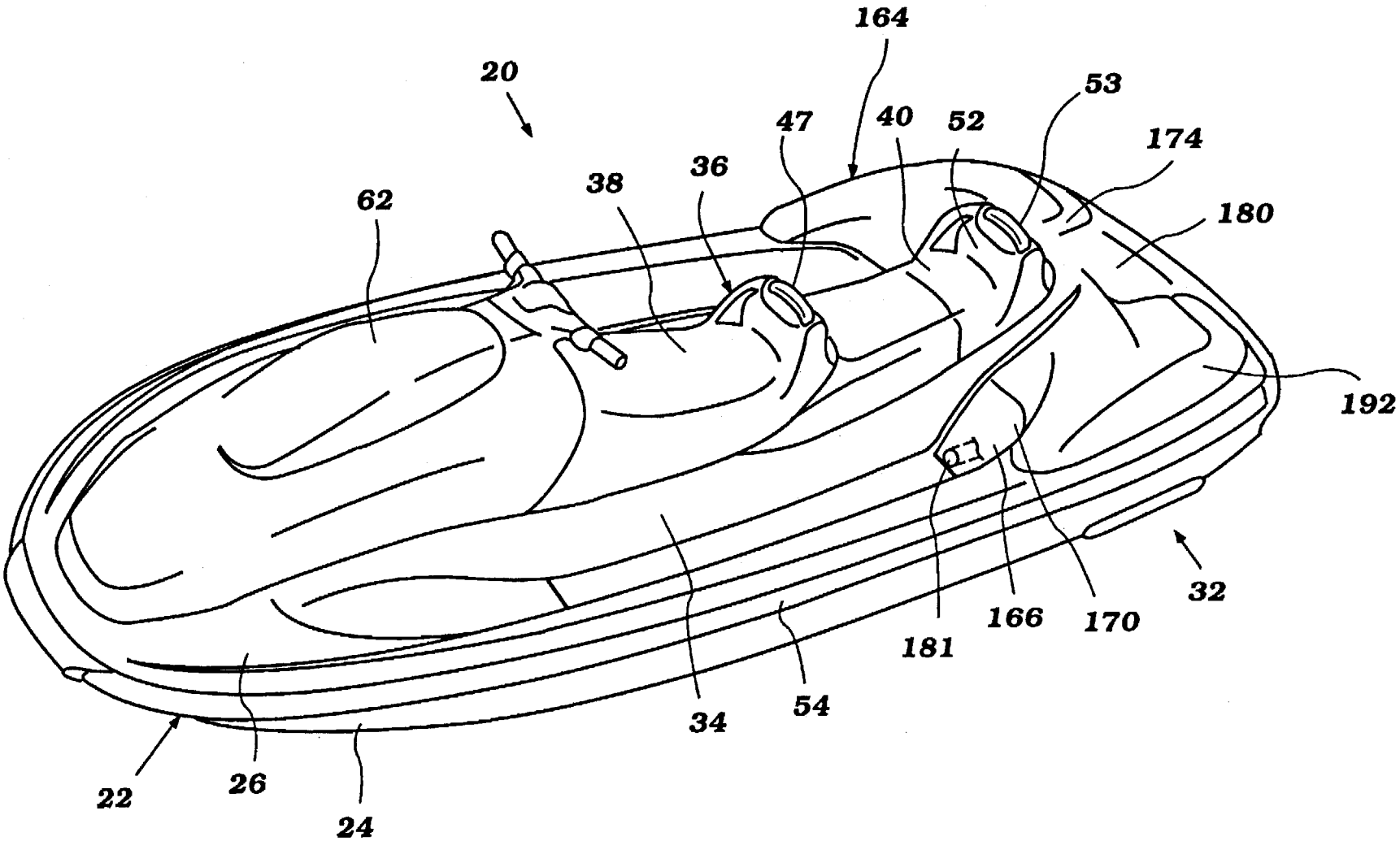
FIG. 3 is a perspective view of a second embodiment of the buoyant storage assembly on a personal watercraft.
Figure 4:
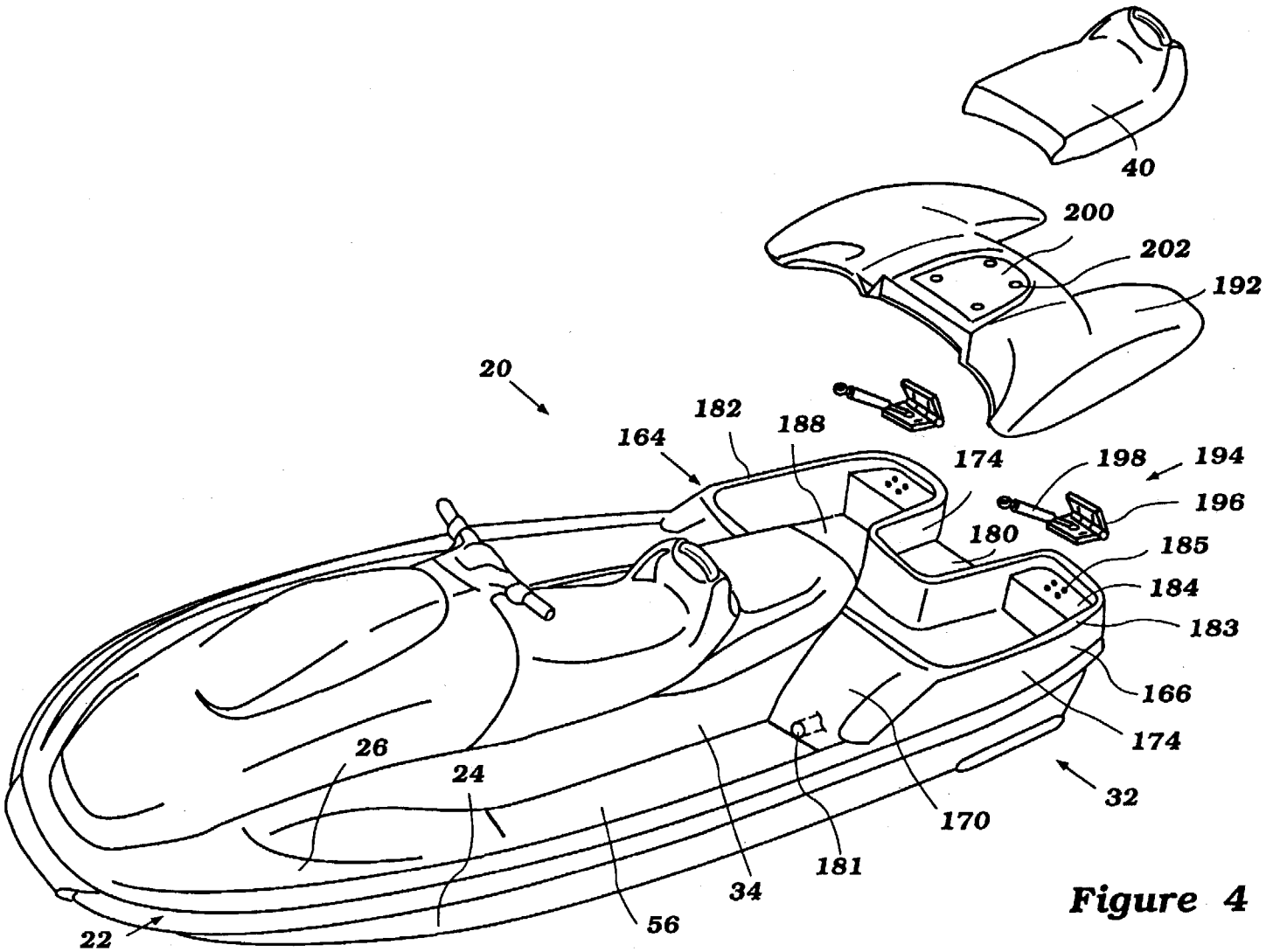
FIG. 4 is a similar view to FIG. 3 and includes a partially exploded view of the buoyant storage assembly.

Referring to FIGS. 3 and 4, a second embodiment of the present invention will now be described. A buoyant storage assembly 164 is provided in the stern portion 32 of the watercraft 20. The buoyant storage assembly 164 includes a raised storage housing 166 that is formed integrally with the upper deck portion 26 and extends transversely from the raised pedestal 34 to the raised gunnels 54. The storage housing 166 includes an upwardly-angled front face 170 and a generally vertically-extending wall 174 that, together with a rear part of the raised pedestal 34, form a generally C-shaped storage arrangement.

A lower platform 180 is provided at the rear of the watercraft for assisting a rider in boarding the watercraft. A pair of drain hoses 181, similar to drain hoses 57 discussed above, extend from the upwardly-angled front face 170 to the rear of watercraft for draining water from the foot areas 56. As mentioned above, the lower platform 180 and drain hoses 181 permit the areas at the sides of the raised pedestal 34 and in the stern portion 32 to be used for the buoyant storage assembly 164.

The storage housing 166 includes a generally C-shaped hole 182. A flat shoulder 183 is formed at the periphery of the generally C-shaped hole 182. A pair of recessed areas 184 are provided near the rear of the storage housing 166 for a purpose to be described. Each of the recessed areas includes a plurality of fastener holes 185. A generally C-shaped storage container or liner 188 is disposed within the housing 166 for storing personal items. The container or liner 188 is removable from the storage housing for gaining access to the jet propulsion unit.

A storage cover 192 is pivotally mounted to the recessed areas 184 of the housing 166 by a pair of hinge arrangements 194. Each hinge arrangement 194 includes a pair of pivotally connected hinges 196 that are mounted to the storage cover 192 and recessed area 184 with threaded fasteners (not shown). The hinge arrangement includes a retarding means 198, such as a gas cylinder, that is provided between storage cover 192 and the recessed area 184 for assisting in the opening of the cover 192. The top of the storage cover 192 includes an upper platform 200. The upper platform includes a plurality of fastener holes 202 that are used in conjunction with a plurality of threaded fasteners (not shown) for mounting the rear seat 40 to the upper platform 200. A seal (not shown) may be provided on the shoulder 186 of the housing 166 for sealingly engaging the cover 192 with the housing 166 so as to prevent water from entering the storage assembly 164.

The storage cover 192 opens and closes towards the riders area so that the storage container 188 is easily accessible to the riders during use of the watercraft. This arrangement facilitates gaining access to personal storage items during use of the watercraft on the water.

The buoyant storage assembly adds buoyancy and stability specifically to the stern portion of the watercraft to assist a rider in boarding the watercraft. During sporting operations of the personal watercraft, a rider will often fall off the watercraft and be forced to board it from the rear. The concentrated loads applied by the rider to different areas of the stern portion during boarding make the stern portion of the watercraft unstable during the boarding process. The watercraft may be especially unstable if one or more riders are present on the watercraft while one of the riders is boarding because the riders tend to unbalance each other. The additional buoyancy of the buoyant storage assembly assists a rider in boarding the watercraft, especially during multiple passenger boarding, because it adds stability to the stern portion of the watercraft.

Figure 5:
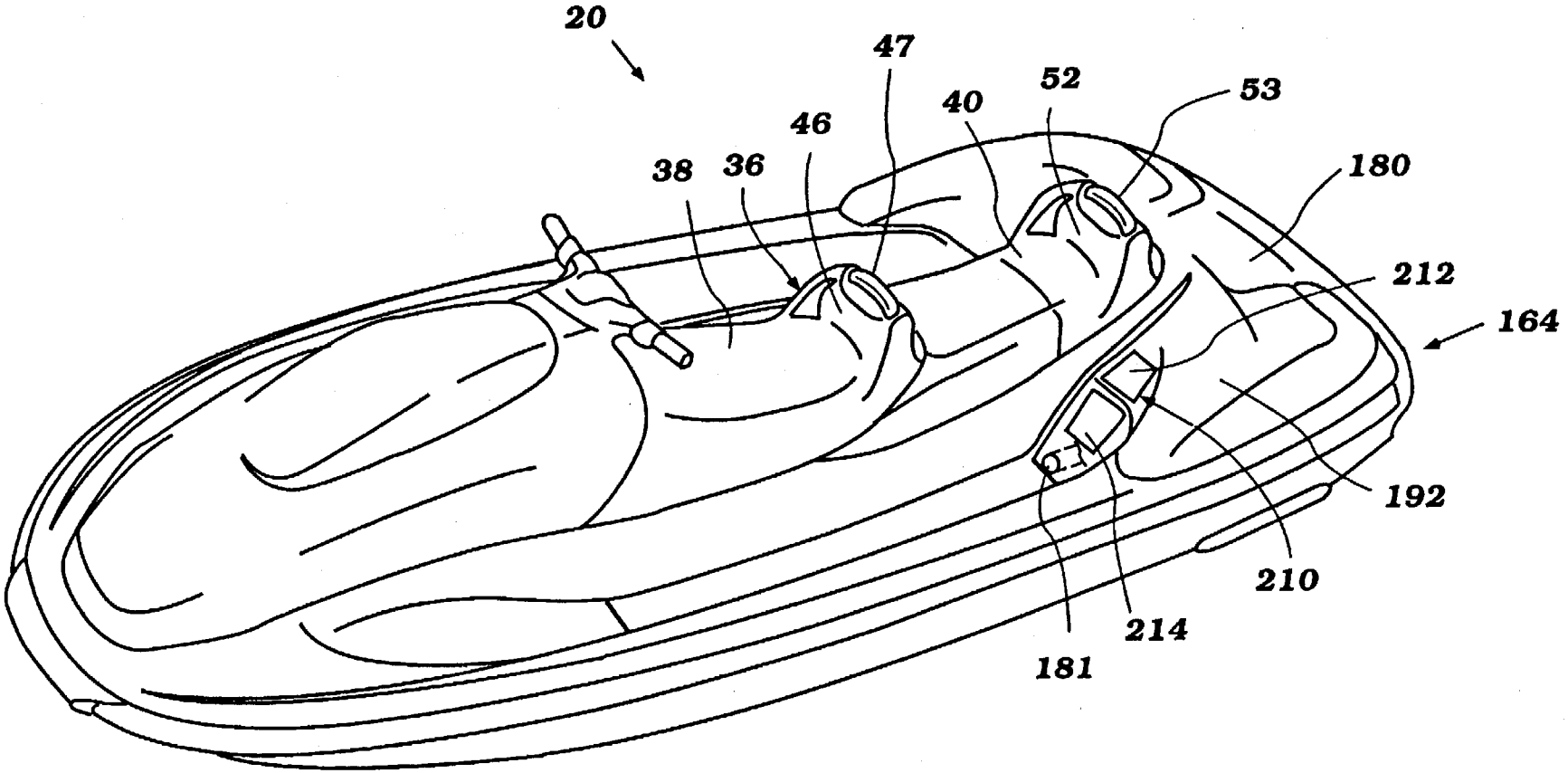
FIG. 5 is a perspective view of a third embodiment of the buoyant storage assembly on a personal watercraft.
Figure 6:
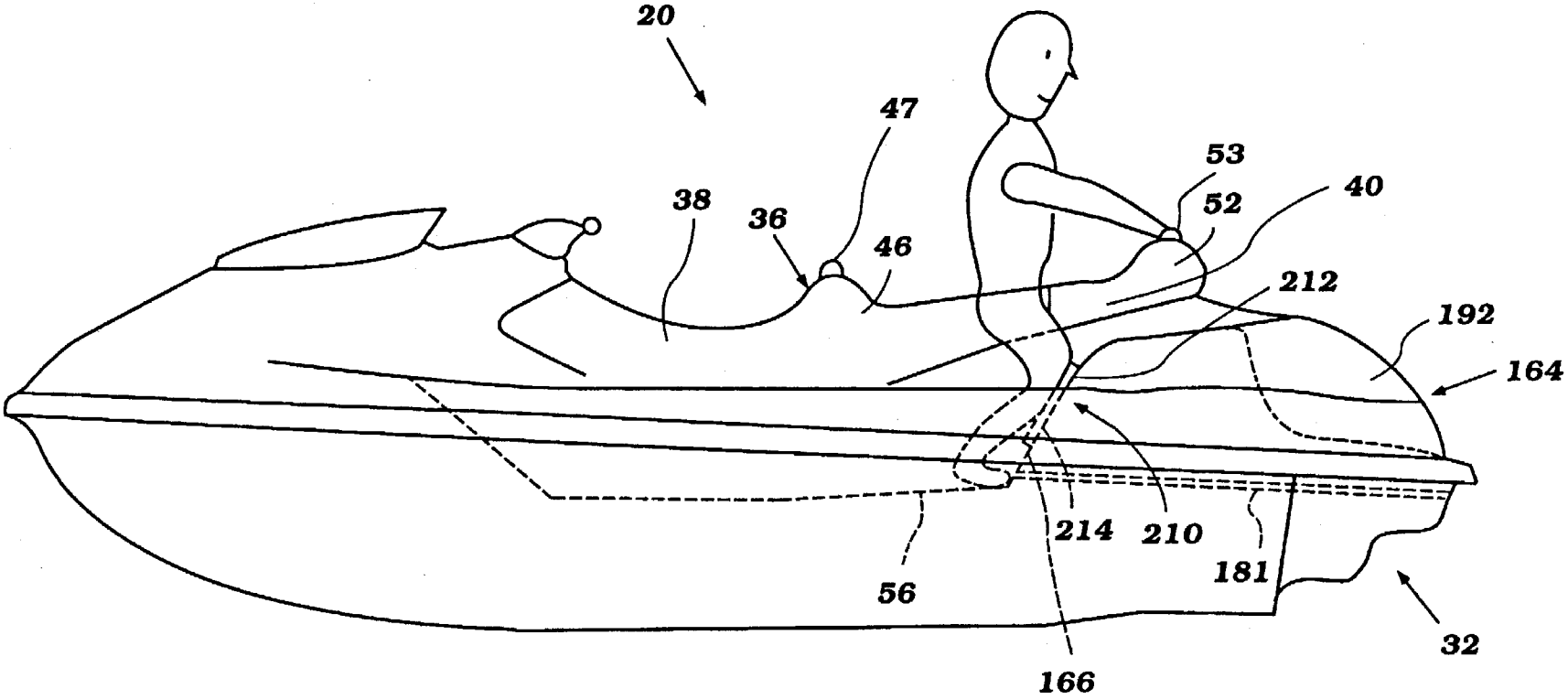
FIG. 6 is a side elevational view of the third embodiment of the buoyant storage assembly on a personal watercraft and shows a rearward-facing passenger on the watercraft.

Referring to FIGS. 5 and 6, a third embodiment of the invention will now be described. A passenger may find it desirable to ride the watercraft 20 facing in a rearward direction for some reasons. To this end, the front of the buoyant storage assembly 164 is designed to provide additional support for a passenger that desires to ride the watercraft in this fashion. The passenger gains additional support by kneeling against the front of the storage assembly 164 and grabbing the handles 53 of the rear seat support 52. In order to cushion the support provided by the front of the storage assembly 164, a pair of knee pads 210 are be provided on the front of the storage assembly 164. Each knee pad 210 includes an upper pad 212 and a lower pad 214. The upper pad 212 is affixed to the front of the storage cover 192 above the junction of the storage cover and upwardly-angled front face 170 of the storage housing 166. The lower pad 214 is affixed to the upwardly-angled front face 170 below this junction.

It should be readily apparent from the foregoing description that the buoyant storage assembly improves the buoyancy and stability of the stern portion of personal watercraft, provides additional storage capacity for the watercraft and provides additional support for a rearward-facing rider. Although a number of embodiments of the invention have been illustrated and described, various changes and modifications that are equivalents to the structure disclosed above may be made without departing from the spirit and scope of the invention as defined by the appended claims.

What is claimed is:

1. A small watercraft comprising a hull, said hull including a bow portion and a stern portion, a raised pedestal provided on said hull, a seating assembly supported by said raised pedestal and including a seat designed to accommodate at least one rider, a buoyant storage assembly formed in the stern portion and extending transversely outward from the raised pedestal so as to provide additional buoyancy and stability in the stern portion of the watercraft when said storage assembly is at least partially immersed in water.

2. The small watercraft of claim 1, wherein said buoyant storage assembly includes a storage housing formed integrally with the hull in the stern portion of the watercraft and extending transversely outward from the raised pedestal, said storage housing includes a container for storing personal items, a storage cover is associated with said storage housing for covering said container, said storage cover sealingly engages the storage housing when closed for adding buoyancy to the hull when said storage assembly is at least partially immersed in water.

3. The small watercraft of claim 2, wherein said container is removable from said storage housing.

4. The small watercraft of claim 2, wherein said storage cover is pivotably mounted to a rear part of the housing assembly so that said cover opens towards a rider sitting in said seat.

5. The small watercraft of claim 4, wherein said cover is pivotally mounted to the housing by a hinge.

6. The small watercraft of claim 5, wherein means for retarding movement of said cover are provided between said cover and said housing assembly.

7. The small watercraft of claim 1, wherein said buoyant storage assembly includes a storage housing formed integrally with the hull in the stern portion of the watercraft and extending transversely outward from the raised pedestal, said storage housing includes a plurality of storage containers for storing personal items, at least one storage cover associated with said storage housing for covering said containers, said at least one storage cover is sealingly engaged with said storage housing when closed for adding buoyancy to the hull when said storage assembly is at least partially immersed in water.

8. The small watercraft of claim 7, wherein the buoyant storage assembly includes a separate storage cover for each of said storage containers.

9. The small watercraft of claim 7, wherein each of said containers is removable from said storage housing.

10. The small watercraft of claim 7, wherein each of said covers is pivotably mounted to a rear part of said housing assembly so that said cover opens towards a rider sitting in said seat.

11. The small watercraft of claim 10, wherein said cover is pivotably mounted to said storage housing by a hinge.

12. The small watercraft of claim 11, wherein means for retarding the movement of said cover are provided between said cover and said housing assembly.

13. The small watercraft of claim 1, wherein the buoyant storage assembly includes a front portion designed to provide knee support for a rider facing in a rearward direction on the watercraft.

14. The small watercraft of claim 13, wherein the front portion includes a knee pad for cushioning the knee support provided by the front portion of the buoyant storage assembly.

* * * * *